US006388433B2

(12) United States Patent
Marty

(10) Patent No.: US 6,388,433 B2
(45) Date of Patent: May 14, 2002

(54) LINEAR REGULATOR WITH LOW OVERSHOOTING IN TRANSIENT STATE

(75) Inventor: Nicolas Marty, Claix (FR)

(73) Assignee: STMicroelectronics, Gentilly (FR)

( * ) Notice: Subject to any disclaimer, the term of this patent is extended or adjusted under 35 U.S.C. 154(b) by 0 days.

(21) Appl. No.: 09/827,295

(22) Filed: Apr. 5, 2001

(30) Foreign Application Priority Data

Apr. 12, 2000 (FR) ..... 00 04673

(51) Int. Cl.[7] ..... G05F 1/40
(52) U.S. Cl. ..... 323/284; 323/274
(58) Field of Search ..... 323/268, 270, 323/271, 273, 274, 280, 282, 284

(56) References Cited

U.S. PATENT DOCUMENTS

| | | | | |
|---|---|---|---|---|
| 5,168,209 A | | 12/1992 | Thiel | 323/313 |
| 5,548,205 A | | 8/1996 | Monticelli | 323/274 |
| 5,852,259 A | * | 12/1998 | Callahan, Jr. et al. | 323/274 |
| 5,929,616 A | | 7/1999 | Perraud et al. | 323/274 |
| 6,201,375 B1 | * | 3/2001 | Larson et al. | 323/277 |
| 6,246,555 B1 | * | 6/2001 | Tham | 361/18 |

FOREIGN PATENT DOCUMENTS

| | | | |
|---|---|---|---|
| EP | 0316781 | 5/1989 | G05F/1/571 |
| EP | 0903839 | 9/1998 | H02M/3/158 |
| EP | 0892332 | 1/1999 | G05F/1/565 |
| EP | 0899643 | 3/1999 | G05F/1/565 |
| EP | 0971280 | 1/2000 | G05F/1/575 |

* cited by examiner

*Primary Examiner*—Matthew Nguyen
(74) *Attorney, Agent, or Firm*—Lisa K. Jorgenson; Allen, Dyer, Doppelt, Milbrath & Gilchrist. P.A.

(57) ABSTRACT

A voltage regulator includes a regulation MOS transistor with low serial resistance having a first terminal connected to a voltage source and a second terminal connected to the output of the voltage regulator and an amplifier having an output driving a gate of the transistor. The gate is driven based upon a difference between a reference voltage and a feedback voltage. The regulator may also include an anti-overshoot switch with a first terminal connected to the gate of the regulation MOS transistor and a second terminal is taken to a potential for turning the regulation MOS transistor off. A switch controller closes the switch when the output voltage of the regulator is higher than a first threshold. The first threshold may be higher than the nominal value of the output voltage.

24 Claims, 3 Drawing Sheets

LINEAR REGULATOR WITH LOW OVERSHOOTING IN TRANSIENT STATE

FIELD OF THE INVENTION

The present invention relates to the field of electronic circuits, and, more particularly, to low drop-out (LDO) type linear voltage regulators, namely low serial voltage drop-out regulators.

BACKGROUND OF THE INVENTION

Low drop-out (LDO) type linear voltage regulators, such as low serial voltage drop-out regulators, are used in a variety of applications. In particular, these regulators may be used in mobile telephones to deliver a regulated voltage from a battery power supply voltage to radio transmission/reception circuits.

By way of example, a standard linear regulator 10 is illustrated in FIG. 1. An output of the regulator 10 delivers a regulated voltage Vout to a load Z. The load Z represents, for example, several radio circuits present in a mobile telephone. The regulator 10 is powered by a voltage Vbat delivered by a battery 1 and comprises a differential amplifier 2 whose output drives the gate G of a P-channel metal oxide semiconductor (PMOS) regulation transistor 3. The output stage of the amplifier 2 has an internal resistance Rg (or gate resistance), shown in dashes, that determines the gain of the amplifier 2 and the maximum current that it can deliver at the output.

The transistor 3 receives the voltage Vbat at its source S. Its drain D, connected to the output of the regulator 10, is connected to the anode of a capacitor Cst for filtering and stabilizing the voltage Vout. This capacitor Cst is parallel-connected with the load Z. The amplifier 2 receives a reference voltage Vref at its negative input and a feedback voltage Vfb at its positive output. The voltage Vfb is, for example, a fraction of the voltage Vout provided to the input of the amplifier 2 by a divider bridge including two resistors R1, R2.

Operation of a regulator of this kind, which is well known to those skilled in the art, includes modulating the gate voltage Vg of the transistor 3 using the amplifier 2. This is done as a function of the difference between the voltage Vfb and the reference voltage Vref. When the voltage Vg is substantially smaller than Vbat−Vtp, the transistor 3 is on because its gate-source voltage Vgs is substantially higher than the threshold voltage Vtp. When the voltage Vg is higher than Vbat−Vtp, the transistor 3 is off. In a stabilized state, the voltage Vout is regulated in the neighborhood of its nominal valve Voutnom, which is equal to [(R1+R2)Vref/R2].

In an application such as supplying power to the radio circuits of a mobile telephone, it is important that the amplifier 2 consume as little electricity as possible to maintain the charge stored in the battery. To this end, the gate resistance Rg of the output stage of the amplifier 2 should be chosen so that it has a high value (e.g., 100 KΩ) to limit the maximum current flowing in the output stage to the high state.

Furthermore, the regulation transistor 3 must have a low serial resistance RdsON in the on state (drain-source resistance) so that it can deliver high current without any prohibitive voltage drop-out at its terminals. Thus, the transistor 3 conventionally has a high gate width-to-length ratio. For example, the transistor 3 may have a gate width W of $2\times10^5$ micrometers for a gate length L of 0.6 micrometers, giving a W/L ratio in the range of $3\times10^5$ micrometers and a very great transistor width. Due to its size and its high W/L ratio, the transistor 3 also has a high gate capacitance Cg (shown in dashes in FIG. 1), in the range of 100 to 200 picofarads.

These various characteristics are indispensable for obtaining a regulator with low consumption and low serial voltage drop-out. Yet, driving a regulation transistor that has high gate capacitance Cg with an amplifier with a limited maximum output current causes an undesirable overshooting phenomena, in certain conditions, at the output of the regulator.

By way of an example, FIGS. 2A, 2B, 2C illustrate a phenomena of voltage overshooting that appears at the output of the voltage regulator of a mobile telephone when the telephone sends data bursts or "GSM bursts" at regular intervals (e.g., every 4 milliseconds). FIG. 2A shows the battery voltage Vbat for which the nominal value Vbatnom is 3.5 V. FIG. 2B shows the gate voltage Vg whose value oscillates in the vicinity of a voltage Vgnom equal to Vbat−Vtp when the regulator is stabilized. In this case, this voltage is about 2.8 V if the threshold voltage Vtp of the transistor is 0.7 V. Finally, FIG. 2C shows the output voltage Vout whose rated value Voutnom is 2.8 V when the regulator is stabilized.

At a time t1, the radio circuits of the telephone go into operation to send a burst. The current consumed is very great and the voltage Vbat drops sharply below the rated value Voutnom (FIG. 2A) due to the internal resistance of the battery. The amplifier 2 is unbalanced, the voltage Vg goes to 0 (FIG. 2B), the gate capacitance Cg is entirely discharged, and the transistor 3 is on. The regulator 10 thus works in follower mode, i.e., where the output voltage Vout is substantially equal to the voltage Vbat (FIG. 2C).

At a time t2, the burst is terminated and the power consumed diminishes. The battery voltage Vbat rises again sharply (e.g., in one microsecond) (see FIG. 2A) until it reaches its nominal value Vbatnom. The output voltage Vout follows the voltage Vbat until, at a time t3, it reaches its nominal voltage Voutnom. At this time, the amplifier 2 releases its output from the low state towards the high state and the gate of the transistor 3 is connected to the voltage Vbat by the gate resistance Rg.

This would normally have led to the transistor 3 being immediately turned off. However, as shown in FIG. 2B, the gate voltage Vg increases very slowly due to the high value of the gate resistor Rg, which limits the current delivered, and the high value of the gate capacitance Cg. The output stage of the amplifier 2 is therefore unable to instantaneously charge the gate capacitor Cg and turn off the transistor 3. The transistor 3 continues to be on and the voltage Vout continues to follow the voltage Vbat. As shown in FIG. 2C, a voltage peak OS thus appears at the output of the regulator. This voltage peak cannot dissipate until an instant t4 when the gate voltage Vg crosses the value Vbat−Vtp that turns the transistor 3 off, provided the load Z consumes current.

SUMMARY OF THE INVENTION

It is an object of the present invention to limit the effect of overshooting at the output of a voltage regulator in a transient state without the need to modify the structure of a regulation transistor thereof to diminish its gate capacitance.

Another object of the present invention is to limit the effect of overshooting in the transient state without the need to increase the maximum current that can be delivered by the output of the regulation amplifier.

These and other objects, features, and advantages are provided by a voltage regulator including a regulation MOS transistor with low serial resistance and an amplifier whose output drives a gate of the transistor based upon a difference between a reference voltage and a feedback voltage. The regulation MOS transistor has a terminal which receives a supply voltage and another terminal connected to the output of the regulator. The regulator further includes a switch having one of its terminals connected to the gate of the regulation MOS transistor while its other terminal is taken to a potential for turning the regulation transistor off. Also, a switch controller or switch control means monitors the output of the regulator and controls the switch. The switch control means closes the switch when the output voltage of the regulator is higher than a first threshold, where the first threshold is higher than a nominal value of the output voltage.

More specifically, the switch control means are laid out to compare the output voltage of the regulator or a voltage proportional to the output voltage with the reference voltage. The switch control means may include a comparator whose output delivers a signal for closing the switch. The comparator may receive the reference voltage at one input and the output voltage, or a voltage proportional to the output voltage, at another input.

Additionally, the comparator may have a switch-over hysteresis chosen so that the switch is reopened when the output voltage becomes lower than a second threshold. The second threshold may be lower than the first threshold and higher than the nominal value of the output voltage. The regulation transistor may be a PMOS transistor, and the turning-off potential may be the supply voltage.

Also, the amplifier may include an output stage including a gate resistor. A value of the gate resistor is set to be too great for the current flowing through the gate resistor to be capable, on its own, of swiftly turning off the regulation transistor when the supply voltage increases rapidly. Additionally, the switch may be a PMOS transistor having a drain-source resistance in the on state that is far lower than the gate resistance of the output stage of the amplifier.

A mobile telephone according to the invention includes a battery and radio circuits powered by the battery using a voltage regulator as described above.

A method aspect of the invention is for limiting overshooting at an output of a voltage regulator when the supply voltage of the regulator increases rapidly. The regulator includes a regulation MOS transistor with a high gate capacitance, a gate of which is driven by an amplifier delivering a current which, by itself, is insufficient to swiftly turn off the regulation transistor. The method may include connecting a switch between the gate of the regulation transistor and a potential for turning off the regulation transistor. Further, the switch may be closed when the output voltage of the regulator becomes higher than a first threshold, where the first threshold is higher than a nominal value of the output voltage. This temporarily helps the amplifier turn off the regulation transistor.

Additionally, the method may include reopening the switch when the output voltage of the regulator becomes lower than a second threshold. The second threshold may be between the nominal value of the output voltage and the first threshold.

BRIEF DESCRIPTION OF THE DRAWINGS

These and other features, characteristics and advantages of the present invention will be explained in greater detail in the following description of an exemplary embodiment of a regulator according to the invention, given by way of non-limitative example, with reference to the appended drawings, in which.

DETAILED DESCRIPTION OF THE PREFERRED EMBODIMENTS

Figure 1:
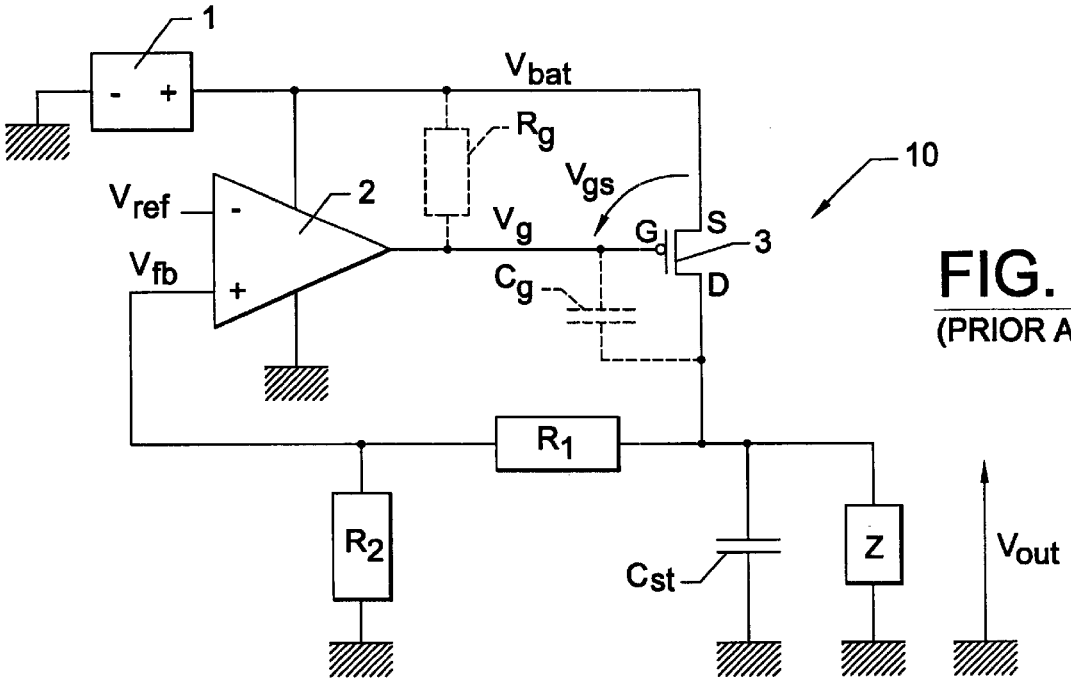
FIG. 1. (PRIOR ART)
FIG. 1 is a schematic diagram of a voltage regulator according to the prior art.
Figure 3:
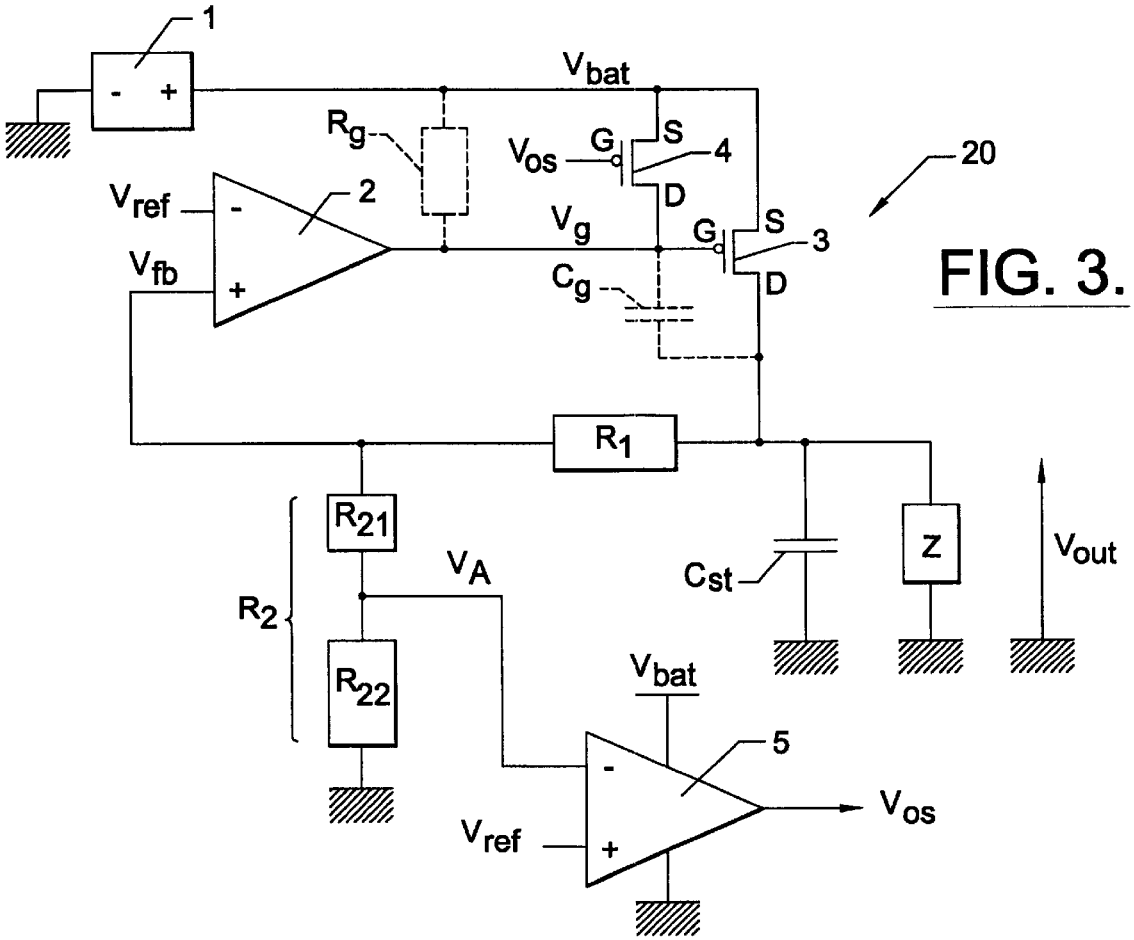
FIG. 3 is a schematic diagram of a voltage regulator according to the invention.

Turning now to FIG. 3, a regulator 20 according to the invention is supplied with a voltage Vbat provided by a battery 1. The regulator 20, like that illustrated in FIG. 1, includes a differential amplifier 2 whose output controls the gate of a PMOS regulation transistor 3. The drain D of the transistor 3 is connected, at the output of the regulator 20, to a stabilizing capacitor Cst parallel-connected with the load Z. These various elements are laid out as described above and are designated by the same references. The output voltage Vout is brought to the positive input of the amplifier 2 by a divider bridge including two resistors R1, R2. The resistor R2 is includes two series-connected resistors R21, R22. The relationship between the output voltage Vout and the feedback voltage Vfb is as follows:

$$Vout=(R1+R2)Vfb/R2 \quad (1)$$

The reference voltage Vref applied to the negative input of the amplifier 2 is, for example, a voltage known as a bandgap voltage having high stability as a function of temperature. The reference voltage Vref is generated by PN junction diodes and current mirrors. The voltage Vref is thus independent of the voltage Vbat, provided of course that it is smaller than the lowest value of the voltage Vbat.

The working of the regulator 20 in a continuous state conforms to that of a prior art regulator. The amplifier 2 keeps the feedback voltage Vfb at a level equal to the reference voltage Vref and the nominal output voltage Voutnom is equal to:

$$(R1+R2)Vref/R2 \quad (2)$$

According to the invention, the regulator 20 includes an anti-overshoot switch 4 connected between the anode of the battery 1 and the gate G of the transistor 3. The switch 4 may be a PMOS type transistor whose source S receives the voltage Vbat and whose drain D is connected to the gate G of the transistor 3. The W/L ratio, namely the length-to-width ratio of the gate of the transistor 4, is chosen so that its serial resistance RdsON in the on state is fairly low. That is, the resistance RdsON is preferably far lower than the gate resistance Rg of the output stage of the amplifier 2.

The gate G of the transistor 4 is driven by a signal Vos delivered by the output of a comparator 5. The comparator 5 is powered by the voltage Vbat and receives the voltage Vref at its positive input and a voltage VA at its negative input. The voltage VA is taken at the midpoint of the divider bridge including the two series-connected resistors R21, R22, and is thus equal to:

$$VA=R22\ Vfb/R2 \quad (3)$$

According to the invention, the resistor R21 is smaller than the resistor R22 so that the voltage VA is very close to the voltage Vfb. We can thus write:

$$R21 \times R2 \quad (4)$$

and $$R22=(1-x)\ R2 \quad (5)$$

with "x" ranging between 0 and 1 and being close to 0, where x is, for example, equal to 0.05.

When the regulator is stabilized, the voltage Va is substantially smaller than the voltage Vref. Indeed, the voltage Vfb is, in this case, substantially equal to Vref, and the relationship (3) becomes:

$$VA=R22\ Vref/R2 \quad (6)$$

giving:

$$VA=(1-x)Vref \quad (7)$$

with x smaller than 1 and close to 0 as indicated above and 1−x smaller than 1 and close to 1. Since the voltage VA is smaller than Vref, the output of the comparator 5 is at 1. The signal Vos is thus equal to Vbat and the anti-overshoot transistor 4 remains in the off state, since its gate-source voltage Vgs is zero.

The comparator 5 and the anti-overshoot transistor 4 become active in the transient state when the voltage Vbat rises suddenly after having fallen sharply due to a current consumption peak. This may happen, for example, in the situation explained above (i.e., after the sending of a data burst by the radio circuit of a mobile telephone). A situation of this kind is illustrated in FIGS. 2A, 4A, 4B, 4C which respectively show the profile of the battery voltage Vbat, the voltage Vg delivered by the amplifier 2 to the gate of the regulation transistor 3, the voltage Vout, and the control voltage Vos for the anti-overshoot transistor 4.

During the drop in the voltage Vbat, starting from the time t1, the regulator 20 is unbalanced and goes into follower mode where the output voltage Vout copies the voltage Vbat. During this period, the voltage VA continues to fall and thus remains below the voltage Vref, and the signal Vos at the output of the comparator remains at 1 (Vbat).

At the time t2, the voltage Vbat rises again suddenly and the voltage Vout follows the voltage Vbat. At the time t3, the voltage Vout reaches the regulation point Voutnom and the amplifier 2 changes over its output to the high state. However, as explained above, the amplifier is by design incapable of delivering the current needed to immediately charge the gate capacitor Cg of the transistor 3. The output voltage Vout continues, therefore, to rise after the instant t3 and follows the voltage Vbat and the transistor 3 remains on.

Figures 2A, 2B, 2C, 4A, 4B, 4C:
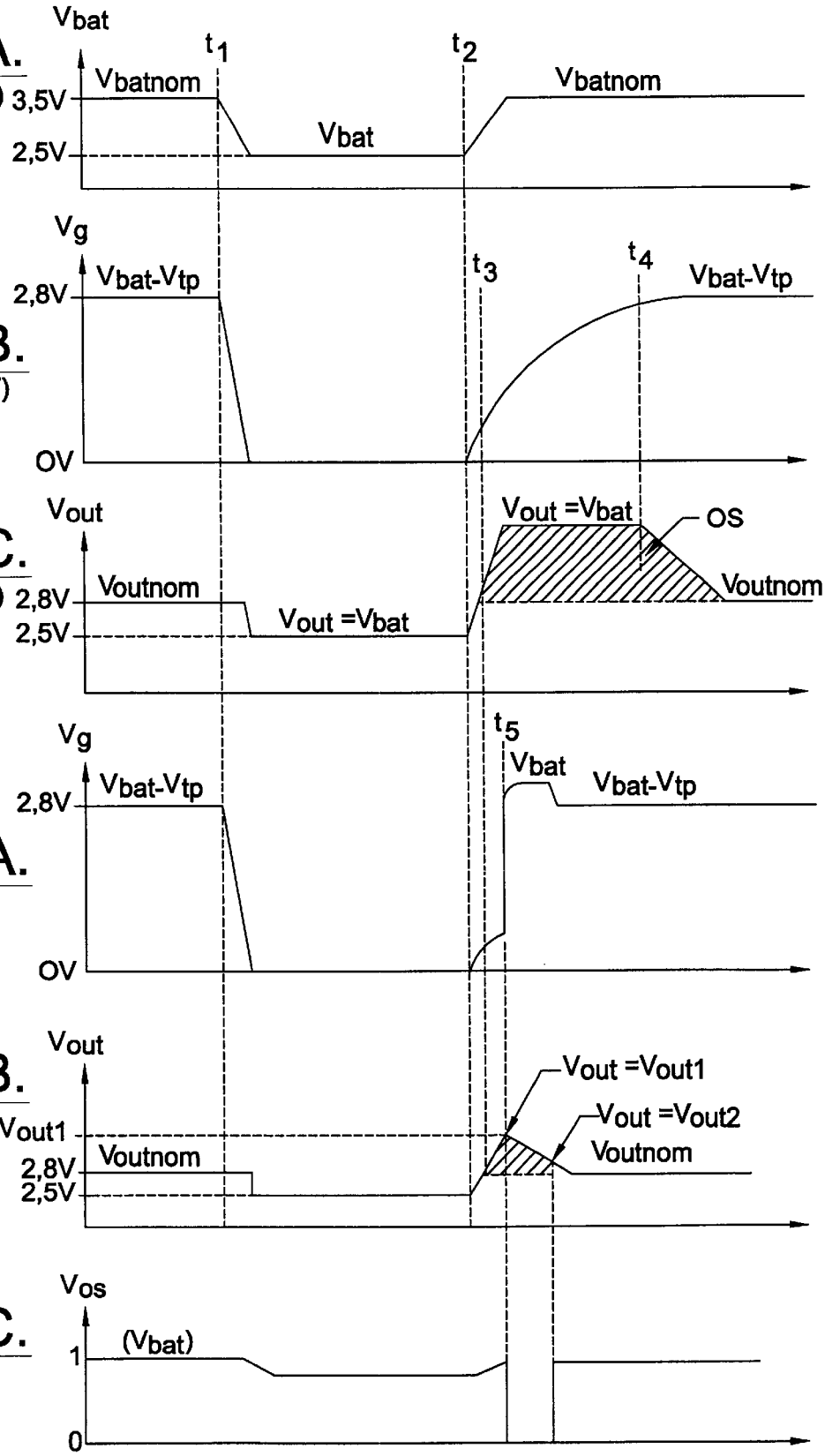
FIG. 2A. (PRIOR ART)
FIG. 2B. (PRIOR ART)
FIG. 2C. (PRIOR ART)
FIGS. 2A to 2C are graphs illustrating the working of the voltage regulator of FIG. 1 in a transient state.
FIGS. 4A to 4C are graphs illustrating the working of the voltage regulator of FIG. 3 in a transient state.

At a time t5 very close to the time t3, the voltage Vout reaches a threshold value Vout1 such that the voltage VA at the input of the comparator 5 becomes equal to Vref. At this point, the output of the comparator 5 changes over to 0 (FIG. 4C) and the anti-overshoot transistor 4 comes on. Since the serial resistance RdsON is low when the transistor 4 is on, the gate G of the regulation transistor 3 receives the current needed to charge the gate capacitor Cg and the transistor 3 goes off almost instantaneously. The voltage Vout stops rising and falls back to its rated value Voutnom (FIG. 4B). According to the invention, the appearance of the voltage peak OS shown in FIG. 2C, which is characteristic of a prior art regulator, is thus neutralized by helping the amplifier 2 to turn the regulation transistor 3 off using the transistor 4.

In practice, the threshold Vout1 for activating the transistor 4 can be defined by the parameter x mentioned above, which is a function of the resistors R1, R2, R21 and R22. Indeed the link between the voltages Vout and VA is the following:

$$Vout=(R1+R2)VA/R22 \quad (8)$$

By combining the relationships (5) and (8), we get:

$$Vout=(R1+R2)VA/(1-x)R2 \quad (9)$$

By replacing VA by Vref and Vout by Vout1 in relationship (9), we get:

$$Vout1=(R1+R2)Vref/(1-x)R2 \quad (10)$$

By combining the relationship (10) and the relationship (2), we get:

$$Vout1=Voutnom/(1-x) \quad (11)$$

and where the term x is small, we get:

$$Vout1 \approx Voutnom+x\ Voutnom \quad (12)$$

giving:

$$Vout1 \approx Voutnom+x\ (R1+R2)Vref/R2 \quad (13)$$

giving:

$$Vout1 \approx Voutnom+K \quad (14)$$

where K is a constant determined by the resistors R1, R2, R21, R22 and the value of Vref.

As a numerical example, a regulator having the values R1=500 KΩ, R2=500 KΩ, R21=25 KΩ, R22=475 KΩ, x=0.05, Vref=1.4 V, and Voutnom=2.8 V provides a threshold Vout1 for the switch-over of the anti-overshoot transistor 4 equal to 2.835 V. In other words, the parasitic overshoot phenomenon is limited in this example to 0.035 V through the present invention, namely to a voltage peak that is negligible with respect to the nominal value of the output voltage.

Naturally, depending upon the desired value Voutnom, the regulator 20 may include a direct feedback of the voltage Vout at the input of the amplifier 2. In this case, the relationships mentioned above are always applicable if we assume that R1=0. Furthermore, it is advantageous in practice for the comparator 5 to have a switch-over hysteresis to avert any instability of the voltage Vout in the vicinity of the threshold Vout1. In this case, the output of the comparator 5 goes to 1 when the voltage VA reaches a value Vref' that is substantially lower than Vref. This value Vref' corresponds, at the output of the regulator 20, to a voltage Vout2 between Voutnom and Vout1 (FIGS. 4B and 4C).

Figure 5:
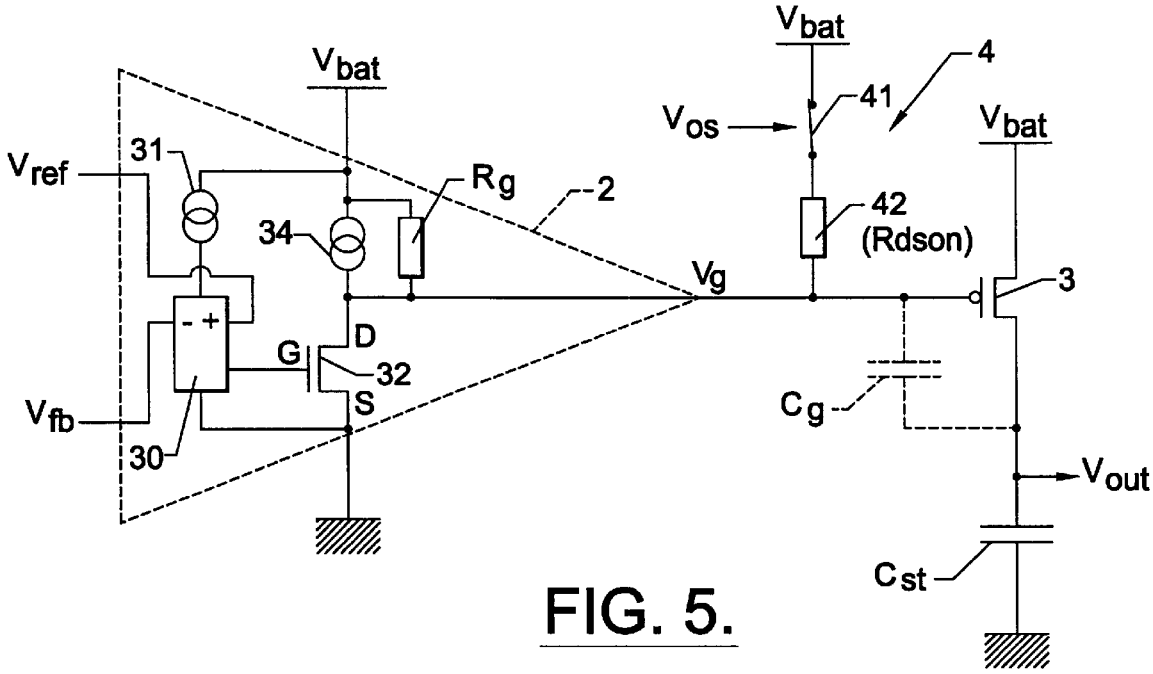
FIG. 5 is a more detailed schematic diagram of the amplifier of the voltage regulator of FIG. 3.

Turning to FIG. 5, an exemplary amplifier structure 2 with low consumption and having a limited output current is shown. The amplifier has a differential stage at its input, shown in the form of a block 30, receiving the voltages Vref and Vfb. The differential stage 30 is biased by a current generator 31 that limits its consumption. The output of the differential stage 30 drives the gate of an N-channel MOS (NMOS) transistor 32 connected between the output node of the amplifier 2 and ground.

The transistor 32 is biased at its drain D by a current generator 33 limiting the consumption of the output stage to the low state. In the amplifier 2, there is also a gate resistor Rg connected to the output node of the amplifier and receiving the voltage Vbat at its other end. Thus, the transistor 32 draws the output of the amplifier to ground and the resistor Rg draws the output of the supply voltage Vbat depending on the value of the signal delivered by the differential stage 30.

Although this exemplary differential amplifier with low power consumption is appropriate to the making of a voltage regulator according to the invention, it goes without saying that the present invention is not limited to this example and can generally be applied to any type of regulation amplifier inasmuch as the output of the amplifier is restrained and is not capable of turning off the regulation transistor speedily in the transient state. Furthermore, it can be seen in FIG. 5 that the anti-overshoot transistor 4 can be modeled in the form of a perfect switch 4-1 series-connected with the resistor 4-2 which herein is a serial resistor RdsON of the transistor. In practice, an external resistor may be added, if necessary, to the switch 4 to limit the charging current of the gate capacitor Cg while maintaining an acceptable turn-off time in the transient state.

The regulator according to the invention is of course capable of having various applications other than those noted above and is also subject to various alternative embodiments and improvements. In one embodiment, the divider bridge formed by the resistors R21, R22 may be eliminated and the voltage Vfb directly applied to an input of the comparator 5. In this case, the comparator 5 is a threshold comparator for a threshold e. The output of the comparator goes to 0 only when the voltage Vfb becomes greater than or equal to Vref+e.

In general, the anti-overshoot switch according to the invention must receive a potential that turns off the regulation transistor. The teaching explained in the present invention can thus be applied to the making of a regulator with an NMOS type regulation transistor for the resolution of the reverse problem of discharging of the gate capacitor of the regulation transistor when it is off. This occurs when the maximum current entering the output stage of the amplifier during its passage to 0 is limited. This potential is, for example, ground with an NMOS regulation transistor.

That which is claimed is:

1. A voltage regulator comprising:

a regulation MOS transistor having a first conduction terminal receiving a supply voltage, a second conduction terminal providing an output voltage of the voltage regulator, and a gate, said regulation MOS transistor having a low serial resistance;

an amplifier for driving the gate of said regulation MOS transistor based upon a difference between a reference voltage and a feedback voltage;

a switch having a first terminal connected to the gate of said regulation MOS transistor and a second terminal connected to a potential for turning said regulation MOS transistor off; and a switch controller for monitoring the output voltage and closing said switch when the output voltage is higher than a first threshold, the first threshold being higher than a nominal value of the output voltage.

2. The voltage regulator according to claim 1 wherein said switch controller compares at least one of the output voltage and a voltage proportional to the output voltage with the reference voltage.

3. The voltage regulator according to claim 2 wherein said switch controller comprises a comparator having a first input receiving the reference voltage, a second input receiving at least one of the output voltage and the voltage proportional to the output voltage, and providing a signal for closing said switch.

4. The voltage regulator according to claim 3 wherein said comparator has a switch-over hysteresis for causing said switch to be opened when the output voltage is lower than a second threshold, the second threshold being lower than the first threshold and higher than the nominal value of the output voltage.

5. The voltage regulator according to claim 1 wherein said regulation MOS transistor comprises a P-channel metal oxide semiconductor (PMOS) transistor; and wherein the potential for turning said regulation MOS transistor off comprises the supply voltage.

6. The voltage regulator according to claim 5 wherein said amplifier comprises an output stage comprising a gate resistor having a resistance value that is large enough to prevent a current flowing through said gate resistor from rapidly turning off said regulation MOS transistor when the supply voltage increases rapidly.

7. The voltage regulator according to claim 6 wherein said switch comprises a PMOS transistor having a drain-source resistance in an on state lower than the resistance value of said gate resistor.

8. A voltage regulator comprising:

a regulation transistor having a first conduction terminal receiving a supply voltage, a second conduction terminal providing an output voltage of the voltage regulator, and a control terminal;

an amplifier for driving the control terminal of said regulation transistor based upon a difference between a reference voltage and a feedback voltage;

a switch having a first terminal connected to the control terminal of said regulation transistor and a second terminal for turning said regulation transistor off; and a switch controller for monitoring the output voltage and closing said switch when the output voltage is higher than a first threshold, the first threshold being higher than a nominal value of the output voltage.

9. The voltage regulator according to claim 8 wherein said switch controller compares at least one of the output voltage and a voltage proportional to the output voltage with the reference voltage.

10. The voltage regulator according to claim 9 wherein said switch controller comprises a comparator having a first input receiving the reference voltage, a second input receiving at least one of the output voltage and the voltage proportional to the output voltage, and providing a signal for closing said switch.

11. The voltage regulator according to claim 10 wherein said comparator has a switch-over hysteresis for causing said switch to be opened when the output voltage is lower than a second threshold, the second threshold being lower than the first threshold and higher than the nominal value of the output voltage.

12. The voltage regulator according to claim 8 wherein said regulation transistor comprises a P-channel metal oxide semiconductor (PMOS) transistor.

13. The voltage regulator according to claim 8 wherein said regulation transistor has a low serial resistance.

14. A mobile telephone comprising:

at least one circuit for transmitting and receiving communications signals;

a battery for supplying power to said at least one circuit; and a voltage regulator for regulating the power supplied by said battery to said at least one circuit, said voltage regulator comprising a regulation transistor having a first conduction terminal receiving a supply voltage, a second conduction terminal providing an output voltage of the voltage regulator, and a control terminal, an amplifier for driving the control terminal of said regulation transistor based upon a difference between a reference voltage and a feedback voltage, a switch having a first terminal connected to the control terminal of said regulation transistor and a second terminal for turning said regulation transistor off, and a switch controller for monitoring the output voltage and closing said switch when the output voltage is higher than a first threshold, the first threshold being higher than a nominal value of the output voltage.

15. The mobile telephone according to claim 14 wherein said switch controller compares at least one of the output voltage and a voltage proportional to the output voltage with the reference voltage.

16. The mobile telephone according to claim 15 wherein said switch controller comprises a comparator having a first input receiving the reference voltage, a second input receiving at least one of the output voltage and the voltage proportional to the output voltage, and providing a signal for closing said switch.

17. The mobile telephone according to claim 16 wherein said comparator has a switch-over hysteresis for causing said switch to be opened when the output voltage is lower than a second threshold, the second threshold being lower than the first threshold and higher than the nominal value of the output voltage.

18. A method for limiting overshooting of an output voltage of a voltage regulator receiving a supply voltage when the supply voltage increases rapidly, the voltage regulator comprising a regulation MOS transistor having a high gate capacitance, the method comprising:

driving a gate of the regulation MOS transistor with a current from an amplifier where the current is independently insufficient to rapidly turn off the regulation transistor;

connecting a switch between the gate of the regulation transistor and a potential for turning off the regulation transistor; and closing the switch when the output voltage of the voltage regulator is higher than a first threshold to temporarily assist the amplifier to turn off the regulation transistor, the first threshold being higher than a nominal value of the output voltage.

19. The method according to claim 18 further comprising opening the switch when the output voltage is lower than a second threshold between the nominal value of the output voltage and the first threshold.

20. The method according to claim 18 wherein the switch is closed by a comparator receiving as inputs a reference voltage from the voltage regulator and a voltage proportional to the output voltage of the voltage regulator.

21. The method according to claim 18 wherein the regulation MOS transistor comprises a P-channel metal oxide semiconductor (PMOS) transistor; and wherein the potential for turning off the regulation transistor comprises the supply voltage.

22. A method for using a voltage regulator comprising a regulation transistor having a first conduction terminal receiving a supply voltage, a second conduction terminal providing an output voltage of the voltage regulator, and a control terminal, the method comprising:

driving the control terminal of the regulation transistor based upon a difference between a reference voltage and a feedback voltage;

connecting a first terminal of a switch to the control terminal of the regulation transistor and a second terminal for turning the regulation transistor off;

monitoring the output voltage; and closing the switch when the output voltage is higher than a first threshold, the first threshold being higher than a nominal value of the output voltage.

23. The method according to claim 22 wherein monitoring comprises comparing at least one of the output voltage and a voltage proportional to the output voltage with the reference voltage.

24. The method according to claim 22 further comprising opening the switch when the output voltage is lower than a second threshold defining a switch-over hysteresis with the first threshold, the second threshold being lower than the first threshold and higher than the nominal value of the output voltage.

* * * * *